US012448241B2

(12) United States Patent
Ito

(10) Patent No.: US 12,448,241 B2
(45) Date of Patent: Oct. 21, 2025

(54) MEDIUM CONVEYING APPARATUS TO DETECT PREDETERMINED MEDIUM BASED ON LIFT OF MEDIUM

(71) Applicant: PFU LIMITED, Kahoku (JP)

(72) Inventor: Takumi Ito, Kahoku (JP)

(73) Assignee: PFU LIMITED, Kahoku (JP)

( * ) Notice: Subject to any disclaimer, the term of this patent is extended or adjusted under 35 U.S.C. 154(b) by 105 days.

(21) Appl. No.: 18/336,903

(22) Filed: Jun. 16, 2023

(65) Prior Publication Data

US 2024/0025680 A1 Jan. 25, 2024

(30) Foreign Application Priority Data

Jul. 20, 2022 (JP) ..... 2022-115773

(51) Int. Cl.

| | |
|---|---|
| ***B65H 7/06*** | (2006.01) |
| ***B65H 3/06*** | (2006.01) |
| ***B65H 3/52*** | (2006.01) |
| ***B65H 7/14*** | (2006.01) |

(52) U.S. Cl.

CPC ..... *B65H 7/06* (2013.01); *B65H 3/06* (2013.01); *B65H 7/14* (2013.01); *B65H 2404/1521* (2013.01); *B65H 2553/30* (2013.01); *B65H 2557/30* (2013.01); *B65H 2557/64* (2013.01)

(58) Field of Classification Search

CPC ..... B65H 2511/521; B65H 2511/524; B65H 2511/528; B65H 7/06; B65H 7/14; B65H 7/18; B65H 7/20; B65H 3/06; B65H 3/0684; B65H 2557/30; B65H 2557/64

See application file for complete search history.

(56) References Cited

U.S. PATENT DOCUMENTS

| | | | | |
|---|---|---|---|---|
| 8,636,282 | B2 * | 1/2014 | Oshiro | B65H 7/125 271/145 |
| 2007/0114716 | A1 * | 5/2007 | Morikawa | B65H 3/5261 271/258.01 |
| 2021/0188581 | A1 * | 6/2021 | Niwata | B65H 3/0661 |
| 2022/0204294 | A1 * | 6/2022 | Eguchi | B65H 5/062 |

FOREIGN PATENT DOCUMENTS

| | | | |
|---|---|---|---|
| JP | 2008169026 A | * | 7/2008 |
| JP | 2019163145 A | * | 9/2019 |
| JP | 2020-83563 A | | 6/2020 |

* cited by examiner

*Primary Examiner* — Luis A Gonzalez

(74) *Attorney, Agent, or Firm* — Womble Bond Dickinson (US) LLP

(57) ABSTRACT

A medium conveying apparatus includes a pick roller feeding a medium, a separation roller located on a downstream side of the pick roller, a conveyance roller located on a downstream side of the separation roller, a medium sensor being located on a downstream side of the separation roller and detecting the medium, a lift sensor detecting a lift of the medium on an upstream side of the conveyance roller, a passing sensor being located on an upstream side of the separation roller and detecting passing of the medium, and a processor to determine that the medium is a predetermined medium when a lift of the medium and passing of the medium are detected in a predetermined period after the medium is detected, and execute abnormality control when the medium is determined to be the predetermined medium.

20 Claims, 15 Drawing Sheets

MEDIUM CONVEYING APPARATUS TO DETECT PREDETERMINED MEDIUM BASED ON LIFT OF MEDIUM

CROSS-REFERENCE TO RELATED APPLICATION

This application is based upon and claims the benefit of priority of prior Japanese Patent Application No. 2022-115773, filed on Jul. 20, 2022, the entire contents of which are incorporated herein by reference.

FIELD

The present invention relates to a medium conveying apparatus to detect a predetermined medium based on a lift of a medium.

BACKGROUND

In general, a medium conveying apparatus conveying and imaging a medium, such as a scanner, sequentially separates and conveys a plurality of stacked media located on a loading tray. However, when a plurality of media are bound by a staple or the like, the media may be damaged when the media are separated. Therefore, it is required of the medium conveying apparatus to suitably detect such a bound medium and to execute abnormality control such as stopping conveyance.

PTL 1 (Japanese Unexamined Patent Publication (Kokai) No. 2020-83563) discloses an image reading apparatus including a height detection sensor detecting the height of an original surface and an original surface detection sensor being located on an upstream side of the height detection sensor and facing a direction different from the height detection sensor. When the height of an original surface detected by the height detection sensor exceeds a threshold value, or a lift of an original occurs and the original is detected by the original surface detection sensor, the image reading device in PTL 1 determines that a bound original is fed.

SUMMARY

It is an object to provide a medium conveying apparatus, a medium conveying method, and a computer-readable, non-transitory storage medium storing a computer program for more precisely detecting a medium on which abnormality control is to be executed.

According to an aspect of the apparatus, provided is a medium conveying apparatus including a pick roller to feed a medium, a separation roller located on a downstream side of the pick roller in a conveying direction of the medium, a conveyance roller located on a downstream side of the separation roller in the conveying direction, a medium sensor located on a downstream side of the separation roller in the conveying direction to detect the medium a lift sensor to detect a lift of the medium on an upstream side of the conveyance roller in the conveying direction, a passing sensor located on an upstream side of the separation roller in the conveying direction to detect passing of the medium, and a processor to determine that the medium is a predetermined medium when a lift of the medium is detected by the lift sensor and passing of the medium is detected by the passing sensor in a predetermined period after the medium is detected by the medium sensor, and execute abnormality control when the medium is determined to be the predetermined medium.

According to an aspect of the method, provided is a medium conveying method including feeding a medium by a pick roller, detecting the medium by a medium sensor located on a downstream side of a separation roller in the conveying direction, the separation roller being located on a downstream side of the pick roller in a conveying a direction of the medium, detecting a lift of the medium on an upstream side of a conveyance roller by a lift sensor, the conveyance roller being located on a downstream side of the separation roller in the conveying direction, detecting passing of the medium by a passing sensor located on an upstream side of the separation roller in the conveying direction, determining, by a processor, that the medium is a predetermined medium when a lift of the medium is detected by the lift sensor and passing of the medium is detected by the passing sensor in a predetermined period after the medium is detected by the medium sensor, and executing, by the processor, abnormality control when the medium is determined to be the predetermined medium.

According to an aspect of the computer-readable, non-transitory medium, provided is a computer-readable, non-transitory storage medium storing a computer program for a medium conveying apparatus including a pick roller feeding a medium; a separation roller located on a downstream side of the pick roller in a conveying direction of the medium; a conveyance roller located on a downstream side of the separation roller in the conveying direction; a medium sensor being located on a downstream side of the separation roller in the conveying direction and detecting the medium; a lift sensor detecting a lift of the medium on an upstream side of the conveyance roller in the conveying direction; and a passing sensor being located on an upstream side of the separation roller in the conveying direction and detecting passing of the medium, the computer program causing the medium conveying apparatus to execute a process, the process including determining that the medium is a predetermined medium when a lift of the medium is detected by the lift sensor and passing of the medium is detected by the passing sensor in a predetermined period after a medium is detected by the medium sensor, and executing abnormality control when the medium is determined to be the predetermined medium.

DESCRIPTION OF EMBODIMENTS

It is to be understood that both the foregoing general description and the following detailed description are exemplary and explanatory, and are not restrictive of the invention as claimed.

Figure 1:
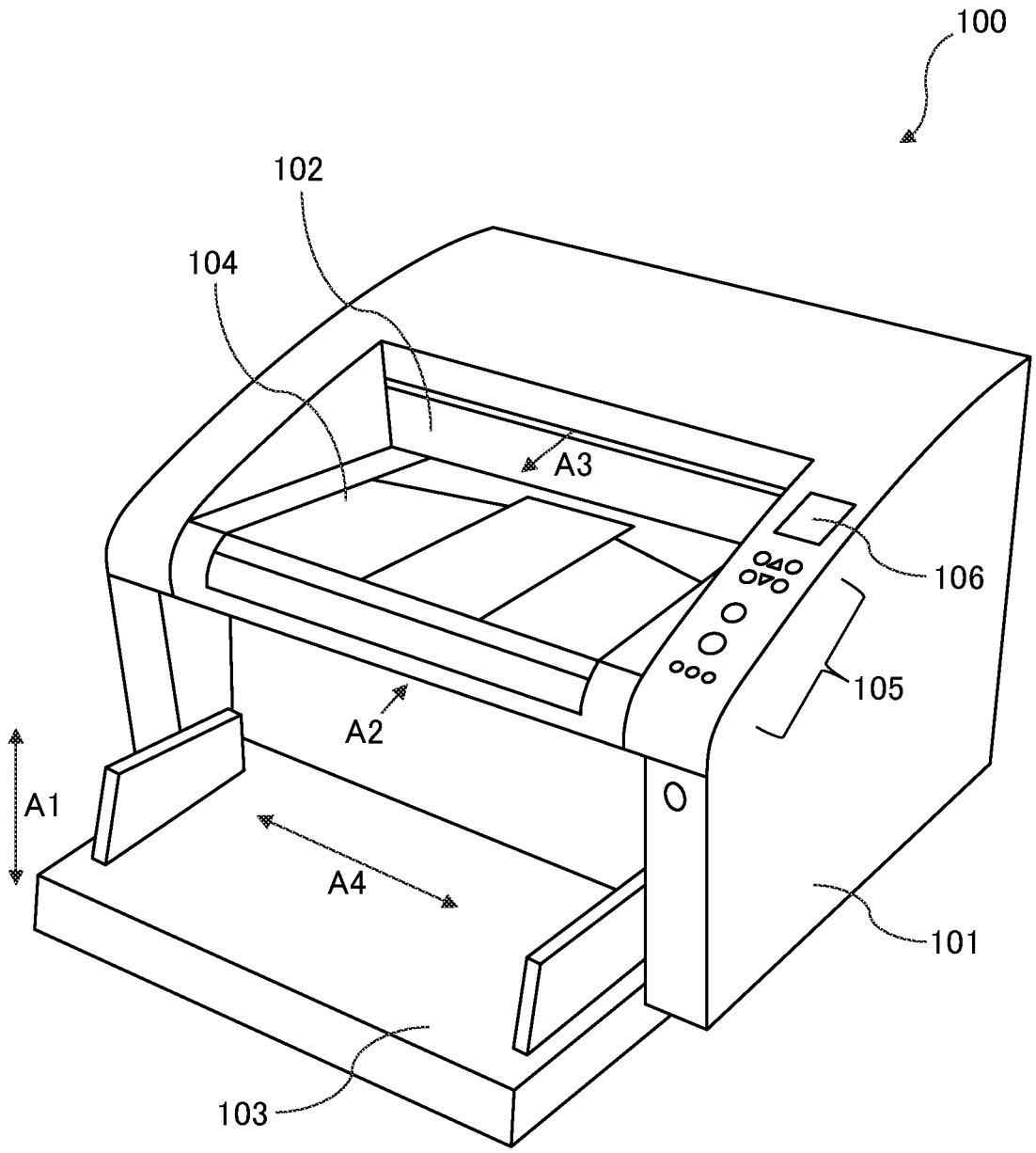
FIG. 1 is a perspective view of a medium conveying apparatus 100.

FIG. 1 is a perspective view illustrating a medium conveying apparatus 100 according to an embodiment. The medium conveying apparatus 100 is an image scanner. The medium conveying apparatus 100 conveys and images a medium being an original. A medium is a paper, a thick paper, a card, or the like. The medium conveying apparatus 100 may also be a facsimile, a copying machine, a multifunctional peripheral (MFP), or the like. The medium conveying apparatus 100 may also be a printer conveying a medium being an object being printed on.

In FIG. 1, an arrow A1 indicates an almost vertical direction (height direction), an arrow A2 indicates a conveying direction of a medium, an arrow A3 indicates an ejecting direction of a medium, and an arrow A4 indicates a width direction orthogonal to the conveying direction A2 or the ejecting direction A3. An upstream side hereinafter refers to an upstream side in the conveying direction A2 or the ejecting direction A3, and a downstream side refers to a downstream side in the conveying direction A2 or the ejecting direction A3.

The medium conveying apparatus 100 includes a first housing 101, a second housing 102, a loading tray 103, an output tray 104, an operation device 105, and a display device 106.

The first housing 101 and the second housing 102 are examples of a housing. The second housing 102 is located inside the first housing 101 and is rotatably engaged with the first housing 101 by a hinge in such a way as to be openable when a jam occurs or cleaning of the inside of the medium conveying apparatus 100 is performed.

The loading tray 103 is engaged with the first housing 101 in such a way as to be able to place a medium to be conveyed. The loading tray 103 is provided on the side of the first housing 101. The loading tray 103 is movable in the height direction A1. The loading tray 103 is positioned at the lower end of the first housing in such a way that a medium can be easily located when a medium is not conveyed. The loading tray 103 is raised to a position where a medium located on the uppermost side comes in contact with a pick roller to be described later when a medium is conveyed.

The output tray 104 is formed on the top surface of the second housing 102. The output tray 104 includes a placement surface for placing a medium ejected from an outlet of the first housing 101 and the second housing 102.

The operation device 105 includes an input device such as a button, and an interface circuit acquiring a signal from the input device. The operation device 105 accepts an input operation by a user and outputs an operation signal based on the input operation by the user. The display device 106 includes a display including a liquid crystal display, an organic electro-luminescence (EL) display, or the like and an interface circuit outputting image data to the display. The display device 106 displays the image data on the display. The display device 106 may be a liquid crystal display with a touch panel function. In this case, the operation device 105 includes an interface circuit acquiring an input signal from the touch panel.

Figure 2:
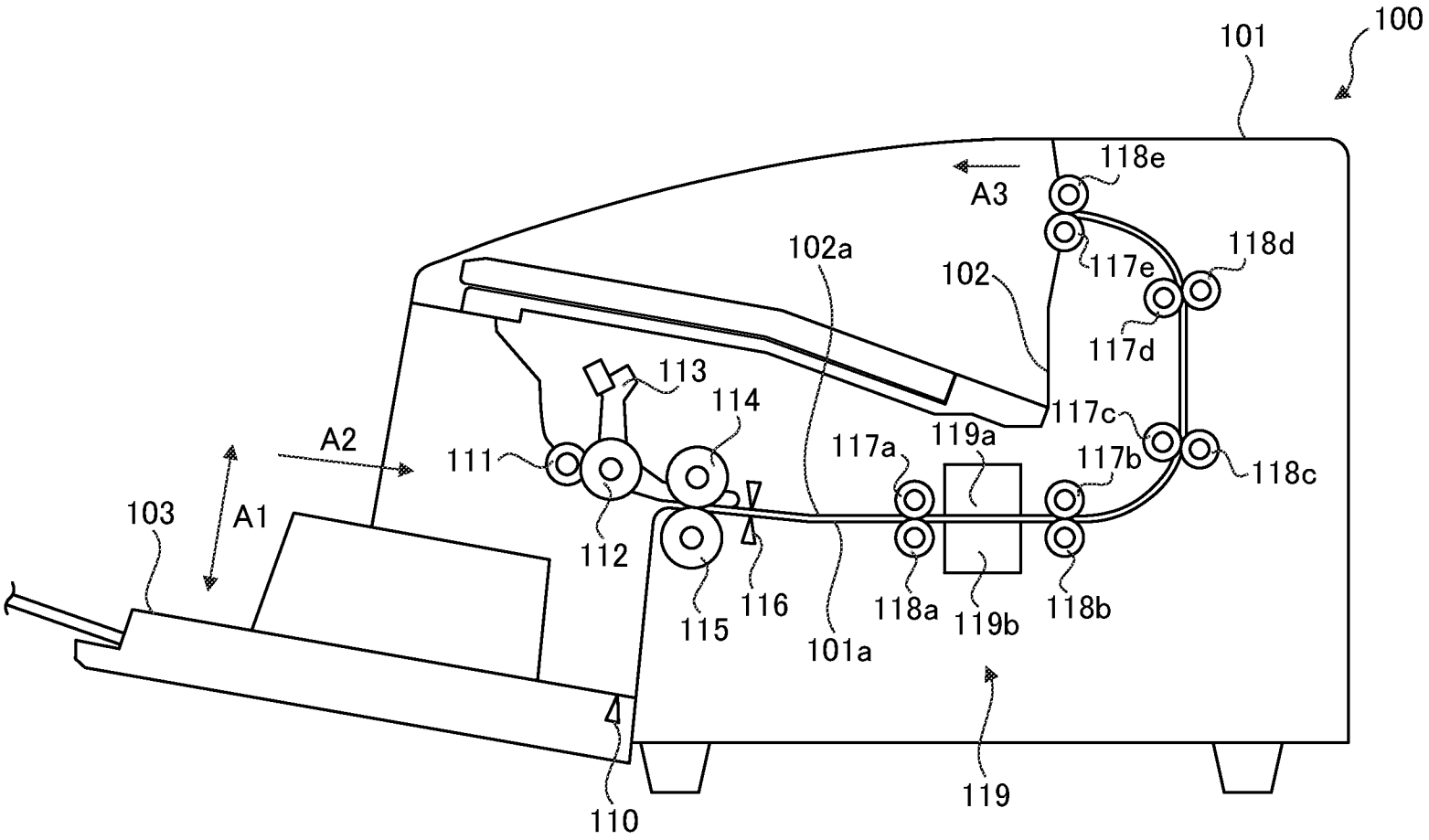
FIG. 2 is a diagram illustrating a conveyance path inside the medium conveying apparatus 100.

FIG. 2 is a diagram illustrating a conveyance path inside the medium conveying apparatus 100.

The conveyance path inside the medium conveying apparatus 100 includes a first medium sensor 110, a passing sensor 111, a pick roller 112, a lift sensor 113, a feed roller 114, a separation roller 115, a second medium sensor 116, first to fifth conveyance rollers 117*a* to *e*, first to fifth driven rollers 118*a* to *e*, and an imaging device 119.

The number of the pick roller 112, the feed roller 114, the separation roller 115, the first to fifth conveyance rollers 117*a* to *e*, and/or the first to fifth driven rollers 118*a* to *e* is not limited to one and may be more than one. In that case, the plurality of pick rollers 112, the feed rollers 114, the separation roller 115, the first to fifth conveyance rollers 117*a* to *e*, and/or the first to fifth driven rollers 118*a* to *e* are respectively spaced in the width direction A4.

A surface of the first housing 101 facing the second housing 102 forms a first guide 101*a* of a conveyance path of a medium, and a surface of the second housing 102 facing the first housing 101 forms a second guide 102*a* of the conveyance path.

The first medium sensor 110 is located on the loading tray 103 on the upstream side of the feed roller 114 and the separation roller 115. The first medium sensor 110 detects whether a medium is located on the loading tray 103. The first medium sensor 110 detects whether a medium is located on the loading tray 103 by a contact detection sensor passing predetermined current when being in contact with a medium or when not being in contact with a medium. The first medium sensor 110 generates and outputs a first medium signal with a signal value varying by whether a medium is located on the loading tray 103. The first medium sensor 110 may be any other sensor, such as a light detection sensor, that can detect whether a medium is located on the loading tray 103.

The passing sensor 111 is located on the upstream side of the separation roller 115 in the second housing 102 in the conveying direction A2 and detects passing of a medium. In the example illustrated in FIG. 2, the passing sensor 111 is located on the upstream side of the pick roller 112. For example, the passing sensor 111 is a slit-type encoder. In this case, the passing sensor 111 includes a rotating member being provided with a slit and rotating with passing of a medium, a light emitting diode (LED), and a photodiode. Light pulses are generated by light emitted from the LED passing through the rotating slit. The passing sensor 111 generates and outputs a signal based on the widths or the interval of light pulses detected by the photodiode, i.e., a signal based on the moving speed of the medium, as a passing signal. For example, when the moving speed of a medium indicated by the passing signal is greater than or equal to a threshold value, the passing sensor 111 detects passing of the medium. The passing sensor 111 may be a magnetic encoder detecting a change in magnetism caused by rotation of a rotating member equipped with a magnet.

The pick roller 112 is located in the second housing 102. The pick roller 112 comes in contact with a medium located on the loading tray 103 raised to a height almost identical to that of the conveyance path of a medium and feeds the medium toward the downstream side.

The lift sensor 113 is located inside the second housing 102 and on the downstream side of the pick roller 112. The lift sensor 113 detects a lift of a medium fed by the pick roller 112. A lift of a medium refers to a fed medium being curved toward the second housing 102 side with respect to the conveyance path. The lift sensor 113 detects a lift of a medium by generating and outputting a lift signal the signal value of which varies by whether the medium lifts. A structure of the lift sensor 113 will be described later by use of FIG. 3.

The feed roller 114 is located inside the second housing 102 and on the downstream side of the pick roller 112. The feed roller 114 feeds a medium fed by the pick roller 112 further toward the downstream side. The separation roller 115 is located inside the first housing 101 in such a way as to face the feed roller 114. The separation roller 115 is a so-called brake roller or a retard roller and can rotate in a direction opposite to the medium feeding direction or can stop. The feed roller 114 and the separation roller 115 separate media and feed one medium at a time. The feed roller 114 is located above the separation roller 115, and the medium conveying apparatus 100 feeds media by a so-called top-first scheme. The feed roller 114 may be located below the separation roller 115, and the medium conveying apparatus 100 may feed media by a so-called bottom-first scheme.

The second medium sensor 116 is located on the downstream side of the feed roller 114 and the separation roller 115. The second medium sensor 116 detects a medium. The second medium sensor 116 is a recurrent prism sensor. The second medium sensor 116 includes a light emitting diode (LED) and a photodiode that are located inside the first housing 101, and a prism located inside the second housing 102. The prism is located in such a way as to face the LED and the photodiode with the conveyance path of a medium in between and to guide light from the LED to the photodiode. The second medium sensor 116 generates and outputs, as a second medium signal, a signal with a signal value being based on the intensity of light detected by the photodiode, i.e., a signal value varying by whether light projected from the LED is blocked by a medium. For example, when the second medium signal indicates that the light projected from the LED is blocked by a medium, the second medium sensor 116 detects the medium. The second medium sensor 116 may be any other sensor, such as a light detection sensor, that can detect a medium.

The first to fifth conveyance rollers 117*a* to *e* and the first to fifth driven rollers 118*a* to *e* are provided on the downstream side of the feed roller 114 and the separation roller 115 in such a way as to face each other, respectively. The first to fourth conveyance rollers 117*a* to *d* and the first to fourth driven rollers 118*a* to *d* convey a medium fed by the feed roller 114 and the separation roller 115 toward the downstream side. The fifth conveyance roller 117*e* and the fifth driven roller 118*e* eject the medium conveyed by the first to fourth conveyance rollers 117*a* to *d* and the first to fourth driven rollers 118*a* to *d* onto the output tray 104.

The imaging device 119 is located on the downstream side of the first conveyance roller 117*a* in the conveying direction A2 and images a medium conveyed by the first conveyance roller 117*a* and the first driven roller 118*a*. The imaging device 119 includes a first imaging device 119*a* and a second imaging device 119*b* that are located in such a way as to face each other with the conveyance path of a medium in between. The first imaging device 119*a* and the second imaging device 119*b* are examples of an imaging unit.

The first imaging device 119*a* includes a line sensor based on a unity-magnification optical system type contact image sensor (CIS) including complementary metal oxide semiconductor-(CMOS-) based imaging elements linearly arranged in a main scanning direction. The first imaging device 119*a* further includes lenses each forming an image on the imaging elements, and an A/D converter amplifying and analog-digital (A/D) converting an electric signal output from the imaging elements. The first imaging device 119*a* generates an input image by imaging the front side of a conveyed medium and outputs the generated image.

Similarly, the second imaging device 119*b* includes a line sensor based on a unity-magnification optical system type CIS including CMOS-based imaging elements linearly arranged in the main scanning direction. The second imaging device 119*b* further includes lenses each forming an image on the imaging elements, and an A/D converter amplifying and A/D converting an electric signal output from the imaging elements. The second imaging device 119*b* generates an input image by imaging the back side of a conveyed medium and outputs the generated image.

The imaging device 119 may include only one of the first imaging device 119*a* and the second imaging device 119*b* and read only one side of a medium. Each of the first imaging device 119*a* and the second imaging device 119*b* may include a line sensor based on a unity-magnification optical system type CIS including charge coupled device-(CCD-) based imaging elements in locate of the line sensor based on a unity-magnification optical system type CIS including CMOS-based imaging elements. Each of the first imaging device 119*a* and the second imaging device 119*b* may include a reduction optical system type line sensor including CMOS-based or CCD-based imaging elements.

A medium located on the loading tray 103 is conveyed between the first guide 101*a* and the second guide 102*a* along the conveying direction A2 by rotation of each of the pick roller 112 and the feed roller 114 in the feeding direction of the medium. As a feed mode of the medium conveying apparatus 100, a user may set either of a separation mode of feeding a medium while separating the medium and a non-separation mode of feeding a medium without separation. The feed mode is set by the user operating the operation device 105 or an information processing device capable of communicating with the medium conveying apparatus 100. When the feed mode is set to the separation mode, the separation roller 115 rotates in a direction opposite to the feeding direction of a medium or stops. Consequently, feed of a medium other than the separated medium is restricted, and multi feed is prevented. On the other hand, when the feed mode is set to the non-separation mode, the separation roller 115 rotates in the feeding direction of a medium.

A medium is conveyed between the first guide 101*a* and the second guide 102*a* by rotation of the first conveyance roller 117*a* in the feeding direction of the medium. The medium is then fed to an imaging position of the imaging device 119, and imaged by the imaging device 119. The medium is further ejected onto the output tray 104 by rotation of each of the second to fifth conveyance rollers 117*b* to *e* in the feeding direction of the medium.

Figure 3:
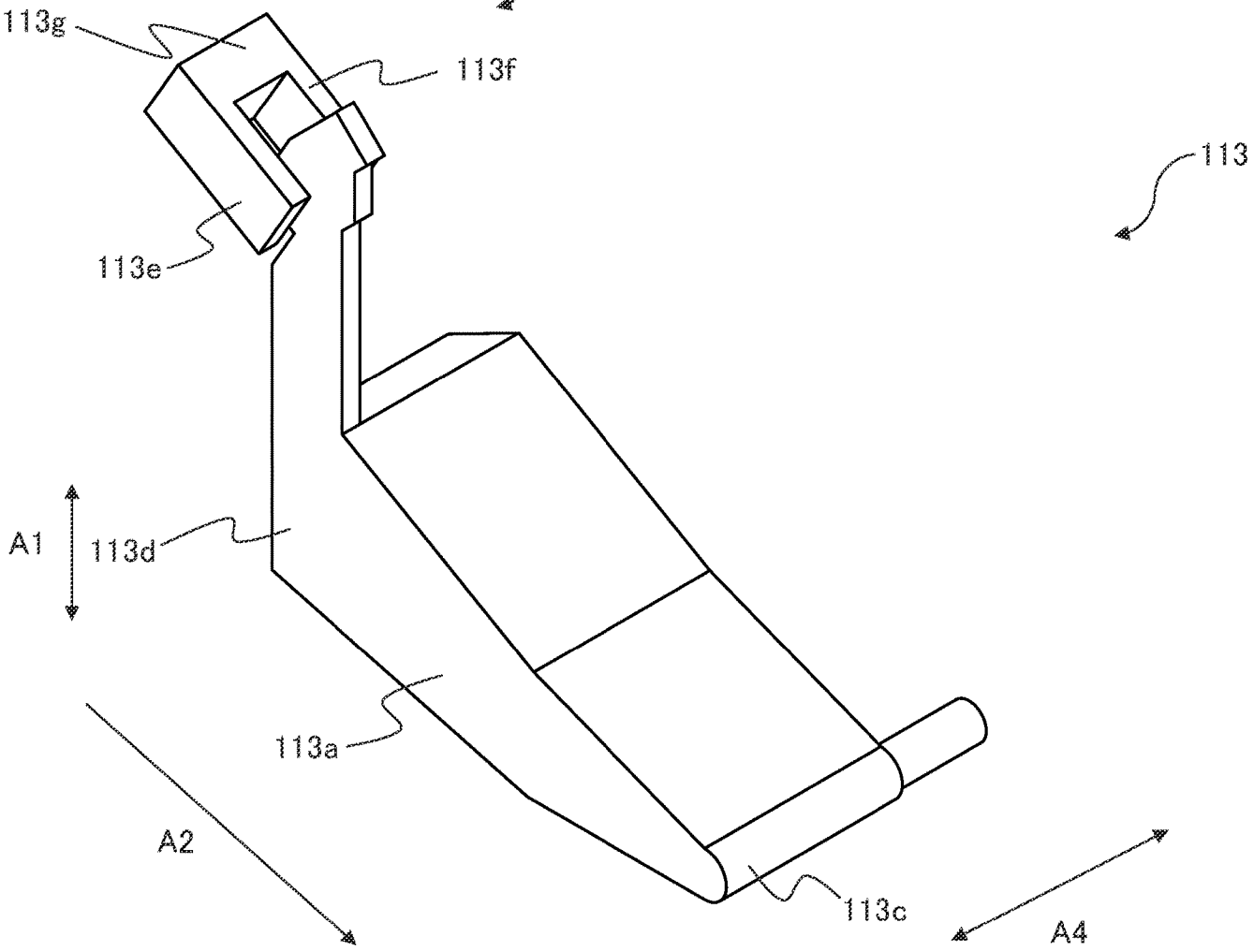
FIG. 3 is a perspective view of a lift sensor 113.

FIG. 3 is a perspective view of the lift sensor 113. The lift sensor 113 includes an arm 113*a* and a horseshoe-shaped sensor 113*b*.

The arm 113*a* is provided above the conveyance path of a medium in such a way as to extend in the medium conveying direction A2 and is located in such a way that the bottom surface of the arm 113*a* faces the first guide 101*a* separated by a predetermined distance. A plurality of lift sensors 113 may be spaced in the width direction A4. In this case, the arms 113*a* are located at an identical height with respect to the first guide 101*a*. A downstream-side edge 113*c* of the arm 113*a* is rotatably engaged with the second housing 102 in such a way that an upstream-side edge 113*d* swings. Consequently, when a medium lifts, the medium comes in contact with the arm 113*a* and raises the arm 113*a* by rotating the arm 113*a*. The distance between the bottom surface of the arm 113*a* and the first guide 101*a* when a lift of a medium does not exist is appropriately set according to the magnitude of bending of a medium required to be detected by the lift sensor 113.

The horseshoe-shaped sensor 113*b* includes a light-emitting element 113*e*, a light-receiving element 113*f*, and a connecting part 113*g*. The connecting part 113*g* connects the light-emitting element 113*e* to the light-receiving element 113*f*. The light-emitting element 113*e* and the light-receiving element 113*f* are located in such a way as to face each other. The light-emitting element 113*e* is an LED or the like and projects light toward the light-receiving element 113*f*. The light-receiving element 113*f* is a photodiode or the like. The light-emitting element 113*e* and the light-receiving element 113*f* are examples of a light-emitting unit and a light-receiving unit, respectively. The light-receiving element 113*f* is provided in such a way as to face the light-emitting element 113*e* with the arm 113*a* in between and detects light from the light-emitting element 113*e*. The light-receiving element 113*f* generates and outputs a lift detection signal being an electric signal based on the intensity of detected light. The horseshoe-shaped sensor 113*b* is an example of a detector.

The arm 113*a* is provided in such a way as to be located between the light-emitting element 113*e* and the light-receiving element 113*f* in an initial state and be located at a position not facing the light-emitting element 113*e* and the light-receiving element 113*f* in a raised state.

In other words, the arm 113*a* is formed in such a way as to interrupt light from the light-emitting element 113*e* to the light-receiving element 113*f* in an unraised state and pass the light from the light-emitting element 113*e* to the light-receiving element 113*f* in the raised state. The horseshoe-shaped sensor 113*b* generates, as a lift signal, a signal with a signal value being based on the intensity of light detected by the light-receiving element 113*f*, i.e., a signal value varying by whether a fed medium lifts. For example, the lift sensor 113 detects a lift of a medium when the intensity of light detected by the light-receiving element 113*f*, the intensity being indicated by the lift signal, is greater than or equal to a threshold value.

Figure 4:
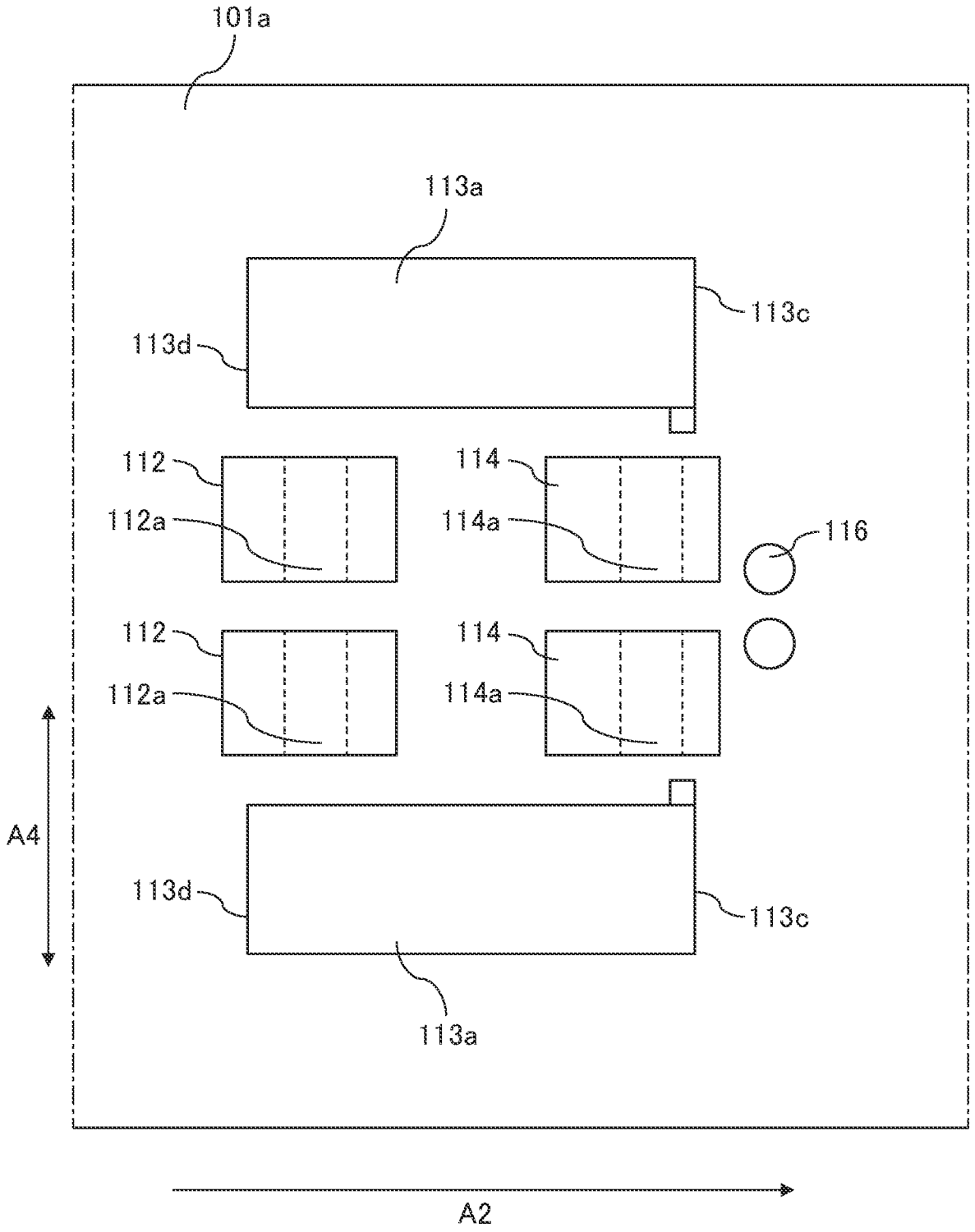
FIG. 4 is a diagram schematically illustrating placement of the lift sensors 113 and a second medium sensor 116.

FIG. 4 is a diagram schematically illustrating placement of the lift sensors 113 and the second medium sensor 116. FIG. 4 is a schematic diagram illustrating a positional relation between the lift sensors 113 and the second medium sensor 116 when the conveyance path is viewed from the top.

In the example illustrated in FIG. 4, each of the two lift sensors 113 is located outside the pick roller 112 and the feed roller 114 in the width direction A4. Structures of the two lift sensors 113 are the same except that the structures are symmetric with respect to the width direction A4. The number of lift sensors 113 is not limited to two and may be one, or three or more.

The lift sensor 113 is located in such a way as to be separated from the pick roller 112 and the feed roller 114 by a predetermined distance in the width direction A4. The predetermined distance is set in such a way that when a medium with the shortest length in the width direction A4 (such as an A5 size) out of media likely to be bound by a staple, a clip, or the like is conveyed at the center in the width direction A4, an edge of the medium in the width direction A4 passes below the arm 113*a*. Consequently, when a bound medium bound by a staple, a clip, or the like is conveyed, the lift sensor 113 can reliably detect a lift of the medium.

The upstream edge 113*d* of the arm 113*a* of the lift sensor 113 is positioned on the upstream side of the upstream edge of a roller nip 112*a* of the pick roller 112. The downstream edge 113*c* of the arm 113*a* of the lift sensor 113 is positioned on the downstream side of the downstream edge of a roller nip 114*a* of the feed roller 114 and the separation roller 115. Consequently, the lift sensor 113 detects a lift of a medium between the upstream edge of the roller nip 112*a* of the pick roller 112 and the downstream edge of the roller nip 114*a* of the feed roller 114 and the separation roller 115.

The second medium sensor 116 is located on the downstream side of the separation roller 115. The second medium sensor 116 is located between the two separation rollers 115 and, for example, is located at the center in the width direction A4. A plurality of second medium sensors 116 may be spaced along the width direction A4.

Figure 5:
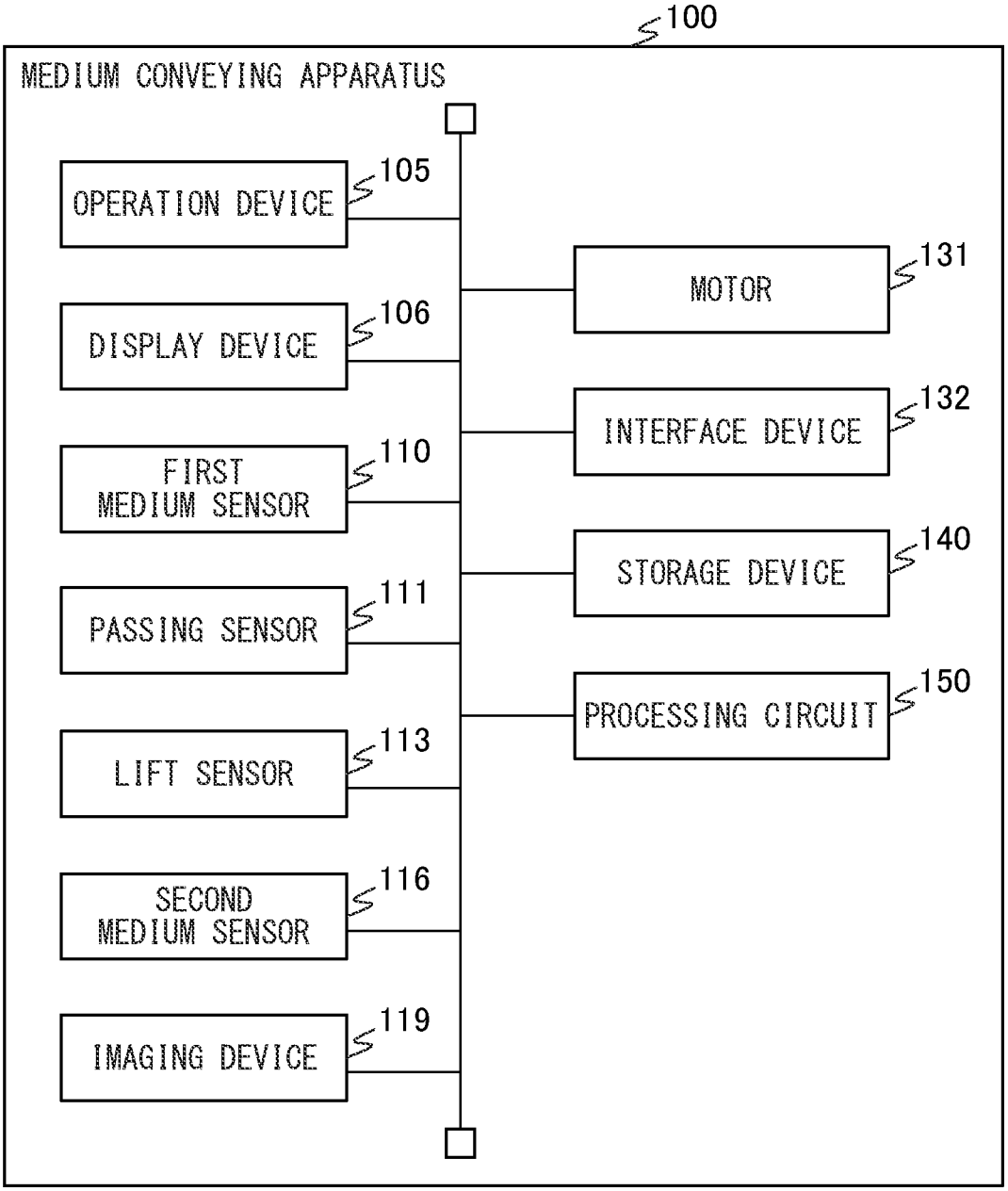
FIG. 5 is a functional block diagram of the medium conveying apparatus 100.

FIG. 5 is a block diagram illustrating an example of a schematic configuration of the medium conveying apparatus 100. In addition to the configuration described above, the medium conveying apparatus 100 further includes a motor 131, an interface device 132, a storage device 140, and a processing circuit 150.

The motor 131 includes one or a plurality of motors. The motor 131 feeds and conveys a medium by rotating the pick roller 112, the feed roller 114, the separation roller 115, and the first to fifth conveyance rollers 117*a* to *e* in accordance with control pulses from the processing circuit 150. The first to fifth driven rollers 118*a* to *e* may be rotated by the motor 131 instead of being driven according to rotation of each conveyance roller.

The interface device 132 includes an interface circuit conforming to a serial bus such as USB. The interface device 132 is electrically connected to an unillustrated information processing device (such as a personal computer or a mobile information terminal) and transmits and receives various types of information including an input image. The medium conveying apparatus 100 may include a communication unit including an antenna transmitting and receiving wireless signals and a communication interface circuit for transmitting and receiving signals through a wireless communication line in locate of the interface device 132. For example, a communication protocol used by the communication interface circuit is a wireless local area network (LAN).

The storage device 140 includes a memory such as a random-access memory (RAM) or a read-only memory (ROM), a fixed disk device such as a hard disk, or a portable storage device such as a flexible disk or an optical disk. The storage device 140 stores a computer program, a database, a table, and the like that are used for various types of processing in the medium conveying apparatus 100. The computer program may be installed on the storage device 140 from a computer-readable and non-transitory portable storage medium by use of a known setup program or the like. Examples of the portable storage medium include a compact disc read-only memory (CD-ROM) and a digital versatile disc read-only memory (DVD-ROM).

The processing circuit 150 operates in accordance with a program previously stored in the storage device 140. For example, the processing circuit 150 is a central processing unit (CPU). Examples of the processing circuit 150 may also include a digital signal processor (DSP), a large-scale integration (LSI), an application specific integrated circuit (ASIC), and a field-programmable gate array (FPGA).

The processing circuit 150 is connected to the operation device 105, the display device 106, the first medium sensor 110, the passing sensor 111, the lift sensor 113, the second medium sensor 116, the imaging device 119, the motor 131, the interface device 132, the storage device 140, and the like and controls these components. The processing circuit 150 conveys a medium by controlling the motor 131, acquires an input image by controlling the imaging device 119, and transmits the acquired input image to the information processing device through the interface device 132. Further, the processing circuit 150 determines whether a conveyed medium is a bound medium, based on a passing signal received from the passing sensor 111, a lift detection signal received from the lift sensor 113, and a second medium signal received from the second medium sensor 116.

Figure 6:
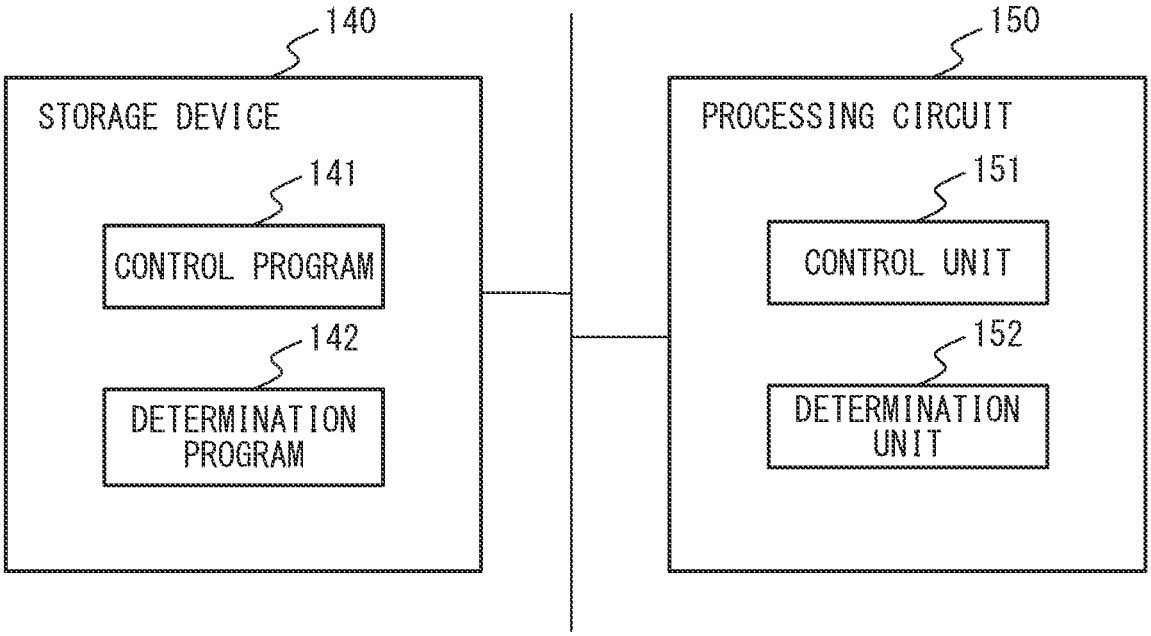
FIG. 6 is a functional block diagram of a storage device 140 and a processing circuit 150.

FIG. 6 is a diagram illustrating schematic configurations of the storage device 140 and the processing circuit 150.

Programs such as a control program 141 and a determination program 142 are stored in the storage device 140. Each program is a functional module implemented by software operating on a processor. The processing circuit 150 functions as a control unit 151 and a determination unit 152 by reading each program stored in the storage device 140 and operating in accordance with the read program.

Figure 7:
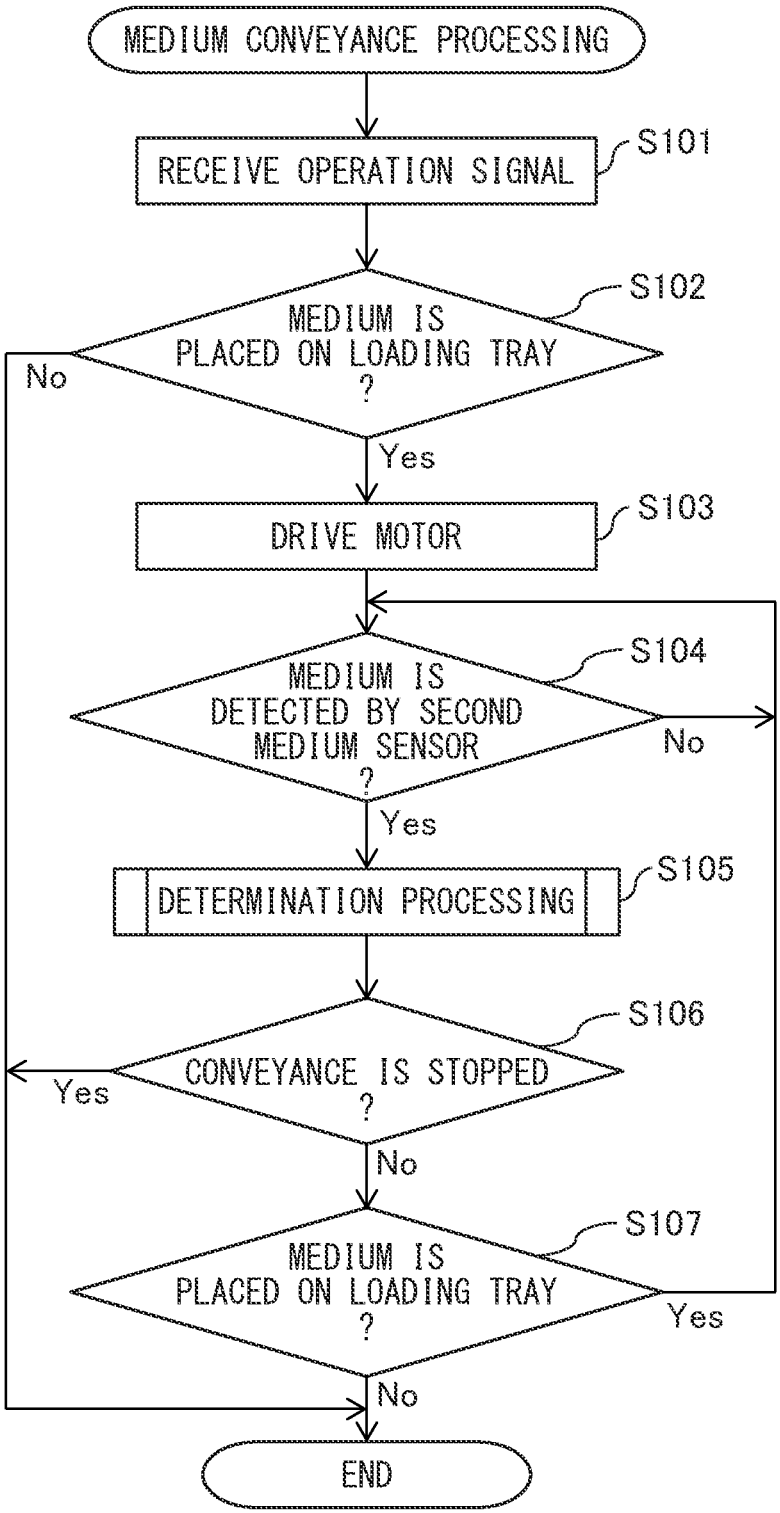
FIG. 7 is a flowchart illustrating a flow of medium conveyance processing.

FIG. 7 is a flowchart illustrating a flow of operation of medium conveyance processing executed by the medium conveying apparatus 100. The medium conveyance processing is achieved by cooperation between the processing circuit 150 and the components in the medium conveying apparatus 100 in accordance with a program stored in the storage device 140.

First, the control unit 151 stands by until an operation signal providing an instruction to read a medium is received (S101). The operation signal is fed to the control unit 151 from the operation device 105 in response to input of a read instruction of a medium to the operation device 105 by a user. The operation signal may be fed from the information processing device through the interface device 132 in response to input of a read instruction to the information processing device by the user.

Next, the control unit 151 determines whether a medium is located on the loading tray 103, based on a first medium signal output from the first medium sensor 110 (S102). When a medium is not located (S102: No), the medium conveyance processing ends.

When a medium is located (S102: Yes), the control unit 151 raises the loading tray 103 to a position allowing feed of the medium by driving a motor for moving the loading tray 103. The control unit 151 feeds and conveys the medium located on the loading tray 103 by rotating the pick roller 112, the feed roller 114, the separation roller 115, and the first to fifth conveyance rollers 117*a* toe by driving the motor 131 (S103).

Next, the control unit 151 determines whether the medium is detected by the second medium sensor 116, based on a second medium signal output from the second medium sensor 116 (S104). When the second medium signal indicates that light projected from the LED is blocked by the medium, the control unit 151 determines that the front edge of the medium has arrived at the position of the second medium sensor 116 and that the medium is detected by the second medium sensor 116. When the medium is not detected by the second medium sensor 116 (S104: No), the control unit 151 returns to S104 and stands by until the medium is detected by the second medium sensor 116.

When the medium is detected by the second medium sensor 116 (S104: Yes), the determination unit 152 executes determination processing of imaging the medium while determining whether the medium is a bound medium (S105). Details of the determination processing will be described later.

Next, the control unit 151 determines whether conveyance of the medium is stopped when the determination processing ends (S106). When conveyance of the medium is stopped (S106: Yes), the medium conveyance processing ends.

When conveyance of the medium is continued (S106: No) and the medium is determined to be located on the loading tray 103, based on the first medium signal output from the first medium sensor 110 (S107: Yes), the medium conveyance processing returns to S104, and the control unit 151 stands by until a next medium is detected by the second medium sensor 116. When a medium is not located (S107: No), the control unit 151 ends the medium conveyance processing by stopping the motor 131.

Figure 8:
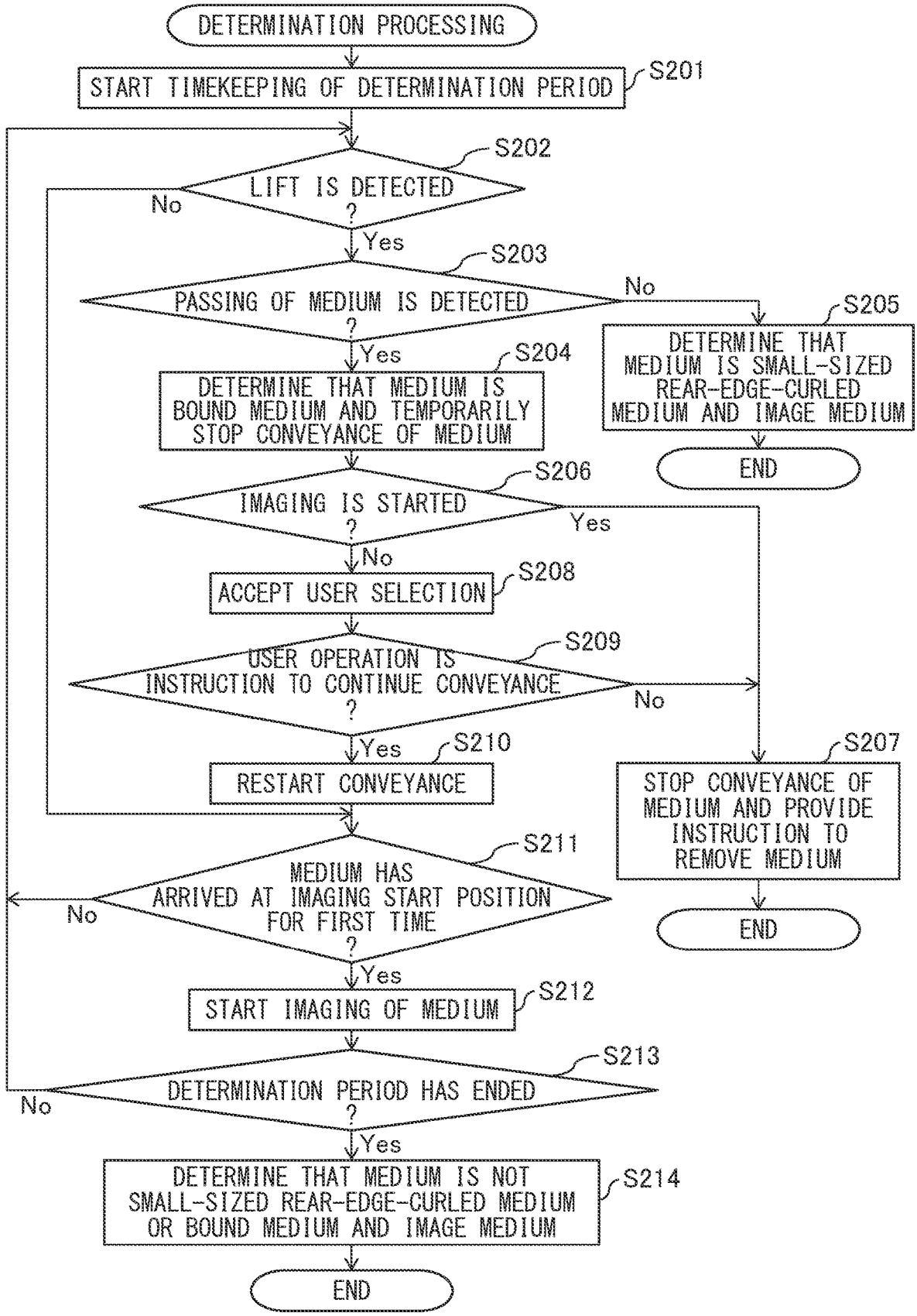
FIG. 8 is a flowchart illustrating a flow of determination processing.

FIG. 8 is a flowchart illustrating a flow of the determination processing executed by the medium conveying apparatus 100 in S105 in the medium conveyance processing. In the determination processing, whether a medium is a bound medium, a small-sized rear-edge-curled medium, or another medium is determined. Then, conveyance is stopped in response to a user operation when the medium is determined to be a bound medium, and conveyance is continued when the medium is determined to be a medium other than a bound medium. A small-sized medium refers to a medium (such as an A5 size) the width of which in the conveying direction A2 of a medium is smaller than that of a standard-sized medium (such as an A4 size). A rear-edge-curled medium refers to a medium the upstream-side edge of which is curved toward the second housing 102 side. Rear-edge-curled media also include a medium bent toward the second housing 102 side in addition to a medium the upstream-side edge of which is curved toward the second housing 102 side.

In the determination processing, whether a medium is a bound medium is continuously determined in a determination period from arrival of the front edge of the medium at the second medium sensor 116 until the medium is further conveyed by a predetermined distance. When the front edge of the medium arrives at an imaging start position before the determination period ends, the medium is imaged in parallel with the determination. The predetermined distance is set to a value greater than the distance from the second medium sensor 116 to the imaging start position. In other words, the predetermined distance is set in such a way that imaging of the medium is started after the determination period is started and before the determination period ends.

First, the determination unit 152 starts timekeeping of the determination period (S201). The determination period is a period from arrival of a medium at the second medium sensor 116 until the medium is further conveyed by the predetermined distance. In this case, the determination unit 152 starts counting of control pulses fed to the motor 131 driving the first to fifth conveyance rollers 117*a* to *e*. The determination period may be a period from arrival of a medium at the second medium sensor 116 until a predetermined amount of time elapses. In this case, the determination unit 152 starts measurement of the amount of time elapsed from the time of arrival of the medium at the second medium sensor 116.

Next, the determination unit 152 determines whether a lift of the medium is detected by the lift sensor 113, based on a lift signal output by the lift sensor 113 (S202). When the intensity of light detected by the light-receiving element 113*f*, the intensity being indicated by the lift signal, is greater than or equal to the threshold value, the determination unit 152 determines that a lift of the medium is detected.

When a lift of the medium is detected by the lift sensor 113 (S202: Yes), the determination unit 152 determines whether passing of the medium is detected by the passing sensor 111, based on a passing signal output by the passing sensor 111 (S203). When the moving speed of the medium indicated by the passing signal is greater than or equal to the threshold value, the determination unit 152 determines that passing of the medium is detected by the passing sensor 111.

When passing of the medium is detected by the passing sensor 111 (S203: Yes), the determination unit 152 determines that the medium is a bound medium, and the control unit 151 temporarily stops conveyance of the medium by stopping the motor 131 (S204). In other words, when a lift of the medium is detected by the lift sensor 113 and passing of the medium is detected by the passing sensor 111 during the determination period, the determination unit 152 determines that the medium is a bound medium. The control unit 151 may display a warning on the display device 106. Stopping of conveyance of a medium and display of a warning are examples of execution of abnormality control.

When passing of the medium is not detected by the passing sensor 111 (S203: No), the determination unit 152 determines that the medium is a small-sized rear-edge-curled medium, and the control unit 151 images the medium by controlling the imaging device 119 (S205). Small-sized refers to the width of a medium in the medium conveying direction A2 being small, and a rear-edge-curled medium refers to a medium the upstream-side edge of which is bent upward. In other words, when a lift of the medium is detected by the lift sensor 113 and passing of the medium is not detected by the passing sensor 111 during the determination period, the determination unit 152 determines that the medium is a small-sized rear-edge-curled medium.

When the medium is determined to be a small-sized rear-edge-curled medium by the determination unit 152, the control unit 151 stands by until the medium arrives at the imaging start position. For example, the imaging start position is positioned between the position of the second medium sensor 116 and the position of the imaging device 119. In this case, when the medium is conveyed by the distance between the second medium sensor 116 and the imaging start position after the medium is detected by the second medium sensor 116, the control unit 151 determines that the medium has arrived at the imaging start position. When the medium arrives at the imaging start position, the control unit 151 acquires input images by sequentially imaging the medium from the downstream side of the medium with conveyance of the medium by controlling the imaging device 119. The control unit 151 transmits the acquired input images to the information processing device through the interface device 132. The above concludes the determination processing. In other words, when a medium is determined to be a small-sized rear-edge-curled medium, the determination processing ends in a state of conveyance of the medium being continued.

When imaging of the medium is started in S212 to be described later before the medium is determined to be a small-sized rear-edge-curled medium in S205, the control unit 151 continues imaging of the medium and acquires input images.

A principle of determining whether a medium is a bound medium or a small-sized rear-edge-curled medium will be described below.

Figure 9A:
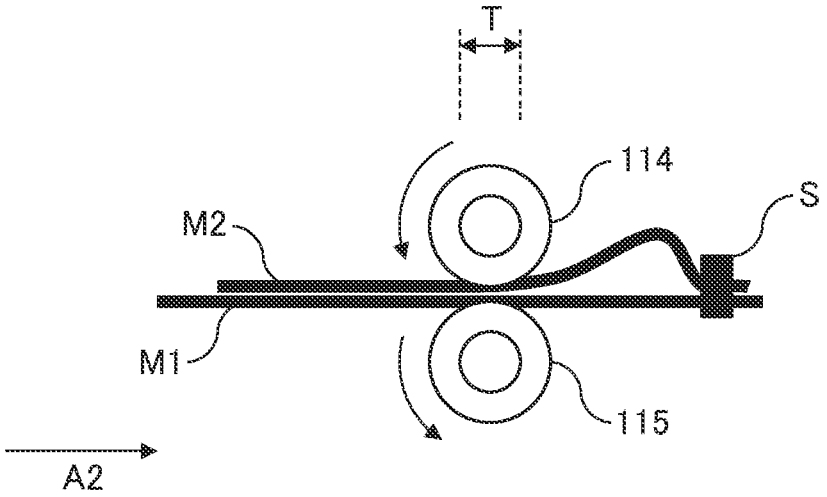
FIG. 9A is a schematic side view of a bound medium.
Figure 9B:
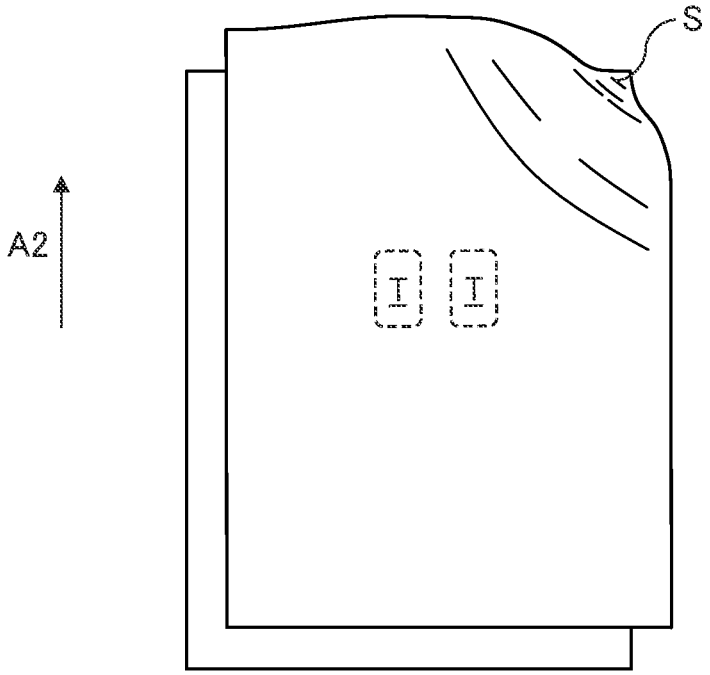
FIG. 9B is a schematic plan view of the bound medium.

FIG. 9A is a schematic side view of a bound medium arriving at the position of the feed roller 114 and the separation roller 115, and FIG. 9B is a schematic plan view of the bound medium. In the example illustrated in FIG. 9A, the bound medium is acquired by binding a lower-side medium M1 and an upper-side medium M2 by a binding part S. When the bound medium arrives at the position of the feed roller 114 and the separation roller 115, the lower-side medium M1 stops by rotation of the separation roller 115, and only the upper-side medium M2 attempts to progress in the medium conveying direction A2 by rotation of the feed roller 114. At this time, since the front edge of the upper-side medium M2 is fixed to the lower-side medium M1 by the binding part S, a lift occurs between a region T of the upper-side medium M2 in contact with the feed roller 114 and the binding part S.

Figure 10A:
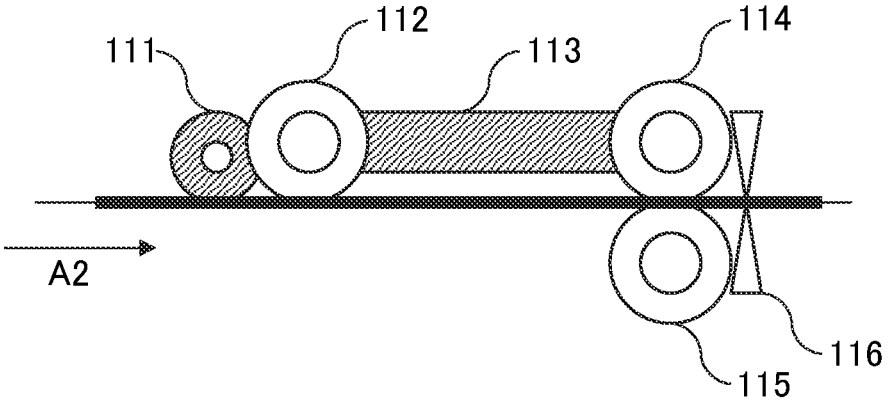
FIG. 10A is a schematic side view of a normal medium.

FIG. 10A is a schematic side view of a normal medium (referring to a medium other than a bound medium and a rear-edge-curled medium) in the determination period. When a normal medium is conveyed, the lift sensor 113 does not detect a lift of the determination period, and the passing sensor 111 detects passing of the medium.

Figure 10B:
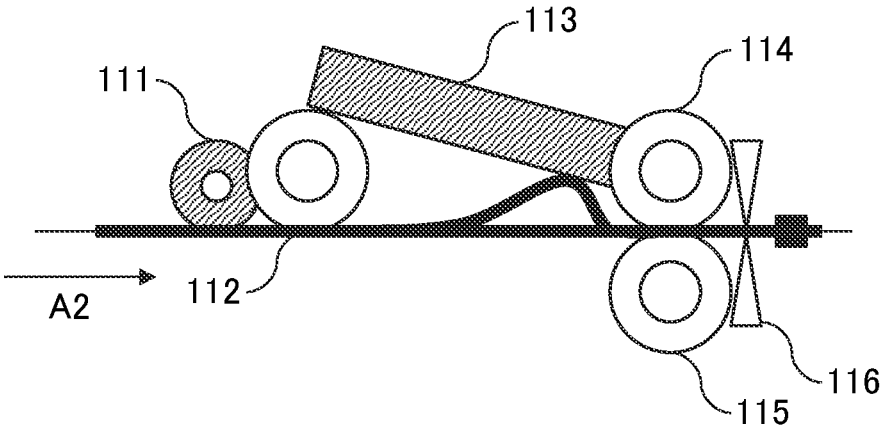
FIG. 10B is a schematic side view of a bound medium.

FIG. 10B is a schematic side view of a bound medium in the determination period. As described above, a lift occurs in a bound medium at the position of the feed roller 114 and the separation roller 115. Accordingly, when a bound medium is conveyed, the lift sensor 113 detects a lift in the determination period, and the passing sensor 111 detects passing of the medium at a point in time when the lift is detected.

Figure 11A:
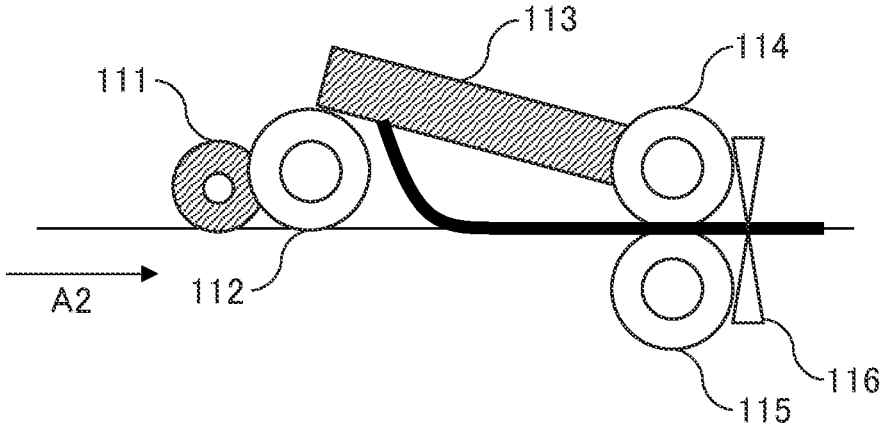
FIG. 11A is a schematic side view of a small-sized rear-edge-curled medium.

FIG. 11A is a schematic side view of a small-sized rear-edge-curled medium in the determination period. When a small-sized medium is conveyed, the rear edge of the medium completes passing the passing sensor 111 and the pick roller 112 and arrives at the position of the lift sensor 113 in the determination period. Further, the rear edge of a rear-edge-curled medium rises after passing the pick roller 112 and pushes up the lift sensor 113. Accordingly, when a small-sized rear-edge-curled medium is conveyed, the lift sensor 113 detects a lift in the determination period, and the passing sensor 111 does not detect passing of the medium at a point in time when the lift is detected.

Figure 11B:
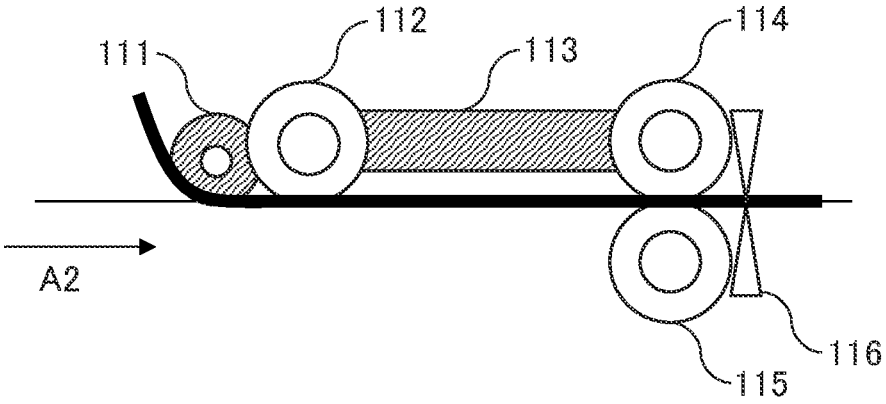
FIG. 11B is a schematic side view of a regular-sized rear-edge-curled medium.

FIG. 11B is a schematic side view of a regular-sized rear-edge-curled medium in the determination period. When a regular-sized rear-edge-curled medium is conveyed, the rear edge of the medium does not arrive at the position of the lift sensor 113 in the determination period, and therefore the lift sensor 113 does not detect a lift.

In other words, by setting the length of the determination period in such a way that the determination period ends before the rear edge of a regular-sized medium arrives at the position of the lift sensor 113, a bound medium and a regular-sized rear-edge-curled medium can be distinguished, based on a detection result of the lift sensor 113. However, a detection result of the lift sensor 113 alone does not allow distinction between a bound medium and a small-sized rear-edge-curled medium. Further use of a detection result of the passing sensor 111 enables distinction between a bound medium and a small-sized rear-edge-curled medium.

Returning to FIG. 8, after the medium is determined to be a bound medium in S204, the control unit 151 determines whether imaging of the medium is started by the imaging device 119 (S206). Since the imaging start position is positioned on the downstream side of the second medium sensor 116, it is determined that imaging by the imaging device 119 is not started immediately after arrival of the medium at the second medium sensor 116. However, as will be described later, the determination unit 152 continuously determines whether the medium is a bound medium throughout a period before the start of imaging of the medium to after the start. Accordingly, it may be determined that imaging by the imaging device 119 is started depending on a timing of occurrence of a lift of the medium.

When imaging of the medium is started (S206: Yes), the control unit 151 displays a screen for instructing the user to remove the medium from the inside of the medium conveying apparatus 100 on the display device 106 (S207). The above concludes the determination processing. In other words, when the medium is determined to be a bound medium and imaging of the medium is started, the determination imaging processing ends in a state of conveyance of the medium being stopped.

When imaging of the medium is not started (S206: No), the control unit 151 displays a screen for accepting user selection of whether to continue conveyance of the medium on the display device 106 (S208).

Next, the control unit 151 determines whether the user operation on the operation device 105 is an instruction to continue conveyance of the medium (S209). When the operation is not an instruction to continue conveyance of the medium (S209: No), the control unit 151 displays a screen for instructing the user to remove the medium from the inside of the medium conveying apparatus 100 on the display device 106 (S207). The above concludes the determination processing.

When the operation is an instruction to continue conveyance of the medium (S209: Yes), the control unit 151 conveys the medium by driving the motor 131 (S210).

After S210, or when a lift of a medium is not detected in S202 (S202: No), the control unit 151 determines whether the medium has arrived at the imaging start position for the first time (S211). When imaging of the medium is not started and the medium has arrived at the imaging start position, the control unit 151 determines that the medium has arrived at the imaging start position for the first time. When imaging of the medium is already started or when the medium has not arrived at the imaging start position (S211: No), the determination processing advances to S202.

When the medium has arrived at the imaging start position for the first time (S211: Yes), the control unit 151 starts imaging of the medium by controlling the imaging device 119 (S212). From then onward, the control unit 151 sequentially images the medium from the downstream side of the medium with conveyance of the medium.

Next, the determination unit 152 determines whether the determination period has ended (S213). For example, the determination unit 152 determines whether the determination period has ended, based on the number of control pulses fed to the motor 131 after detection of the medium by the second medium sensor 116.

When the determination period has not ended (S213: No), the determination processing advances to S202. In this case, whether a lift of the medium and passing of the medium are detected is determined in parallel with imaging of the medium in the remaining determination period.

When the determination period has ended (S213: Yes), the determination unit 152 determines that the medium is not a small-sized rear-edge-curled medium or a bound medium and continues imaging of the medium (S214). The determination unit 152 ending imaging of the medium and acquiring input images transmits the acquired input images to the information processing device through the interface device 132. The above concludes the determination processing.

As described above, when a lift of a medium is detected by the lift sensor 113 located on the downstream side of the separation roller 115 and passing of the medium is detected by the passing sensor 111 located on the upstream side of the separation roller 115 in the determination period, the medium conveying apparatus 100 determines that the medium is a bound medium. Consequently, a bound medium and a small-sized rear-edge-curled medium are distinguished, and therefore the medium conveying apparatus 100 enables more precise detection of a medium on which abnormality control is to be executed.

Further, the medium conveying apparatus 100 accepts user selection of whether to continue conveyance of a medium when imaging of the medium is not started at the point in time when the medium is determined to be a bound medium and stops conveyance of the medium when imaging of the medium is not started. In other words, acceptance of user selection at the point in time when a medium is determined to be a bound medium enables saving of time and effort for the user to locate the medium on the loading tray 103 again when a medium not being a bound medium is erroneously determined to be a bound medium. However, normal input images are not acquired when imaging of the medium started at the point in time when conveyance is temporarily stopped, and therefore the user needs to locate the medium on the loading tray 103 again regardless of whether the determination is erroneous. With the aforementioned configuration, the medium conveying apparatus 100 can save time and effort for the user to locate the medium again and time and effort for the user to select whether to continue conveyance of the medium, thereby enabling improved convenience for the user.

While the determination processing advances to S210 when the operation is an instruction to continue conveyance of the medium in S209 in the determination processing in the aforementioned description, the processing is not limited to such an example. For example, when the user operation is an instruction to continue conveyance of the medium, the determination processing may advance to S205 or S214, image the medium, and end the determination processing. In other words, when the user operation is an instruction to continue conveyance of the medium, the medium conveying apparatus 100 may not determine whether the medium is a bound medium from then onward.

For example, when the user operation is an instruction to continue conveyance of the medium, the determination processing may advance to S205 or S214, image the medium, and end the determination processing. For example, when the medium is determined to be a bound medium in S204, the determination unit 152 may display a screen for accepting selection of whether to continue conveyance of the medium regardless of whether imaging of the medium is started on the display device 106. Such processing can still save time and effort for the user to locate the medium again, thereby enabling improved convenience for the user.

While the passing sensor 111 is assumed to be a slit-type encoder or a magnetic encoder in the aforementioned description, the sensor is not limited to such an example. For example, the passing sensor 111 may detect passing of a medium, based on electromotive force caused by a driven roller rotating according to movement of the medium along the conveying direction A2. In this case, the passing sensor 111 includes a driven roller and a conversion circuit generating voltage based on the rotation speed of the driven roller. The conversion circuit includes a motor rotating with rotation of the driven roller and generating voltage based on the rotation speed, and a peripheral circuit and outputs, as a passing signal, a signal the value of which varies by the generated voltage. For example, when voltage indicated by the passing signal is greater than or equal to a threshold value, the passing sensor 111 detects passing of a medium.

Figure 12:
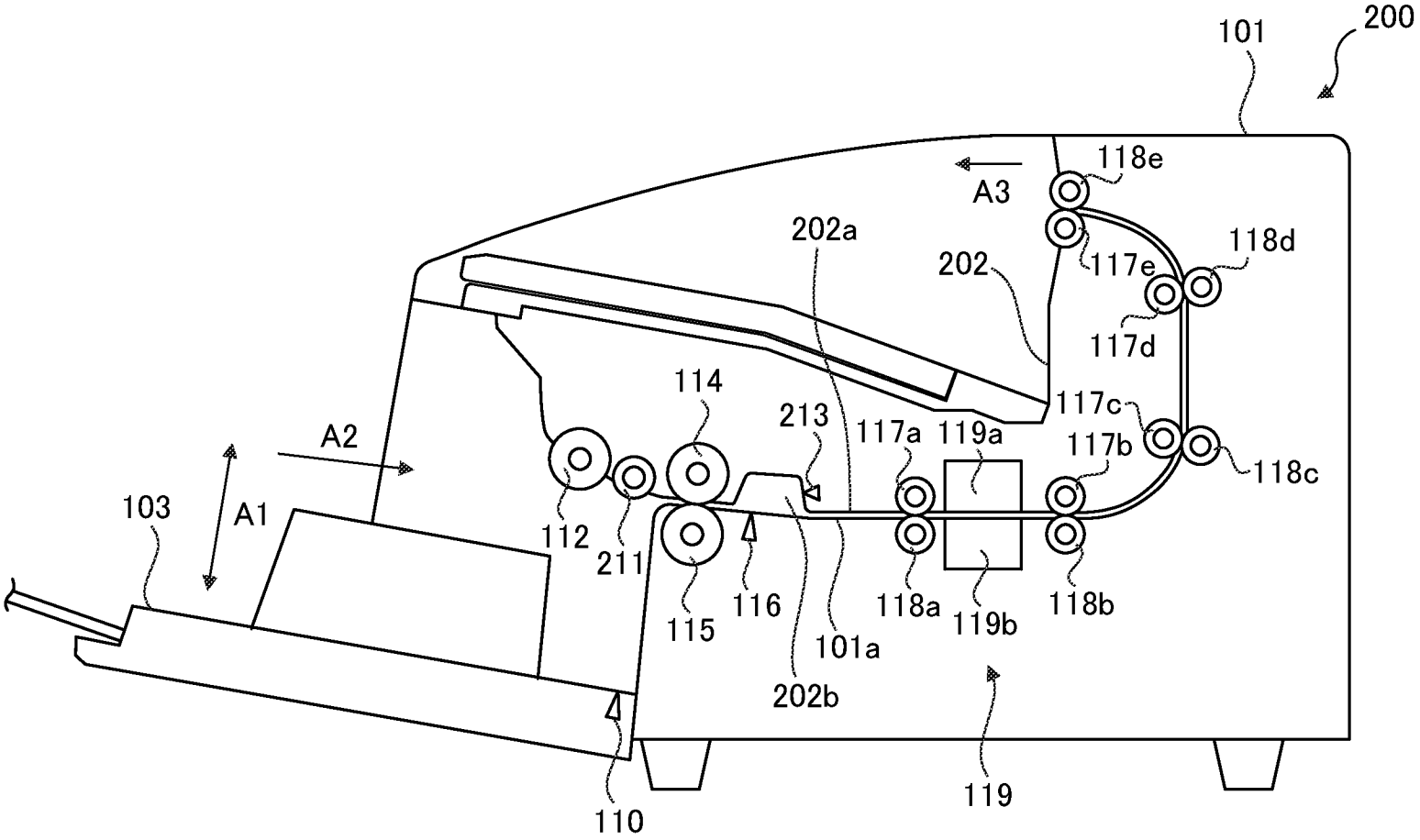
FIG. 12 is a diagram illustrating a conveyance path inside a medium conveying apparatus 200.

FIG. 12 is a diagram illustrating a conveyance path inside a medium conveying apparatus 200 according to another embodiment. The medium conveying apparatus 200 differs from the medium conveying apparatus 100 in including a second housing 202, a passing sensor 211, and a lift sensor 213 in locate of the second housing 102, the passing sensor 111, and the lift sensor 113.

The second housing 202 includes a second guide 202*a* located above a conveyance path of a medium. The second guide 202*a* is formed in such a way as to be almost parallel with a first guide 101*a*. Further, a recessed part 202*b* depressed upward is formed on the second guide 202*a* between a separation roller 115 and a first conveyance roller 117*a*.

The passing sensor 211 is located on the upstream side of the separation roller 115 and on the downstream side of a pick roller 112 and detects passing of a medium. A structure of the passing sensor 211 is similar to the structure of the passing sensor 111.

Figure 13:
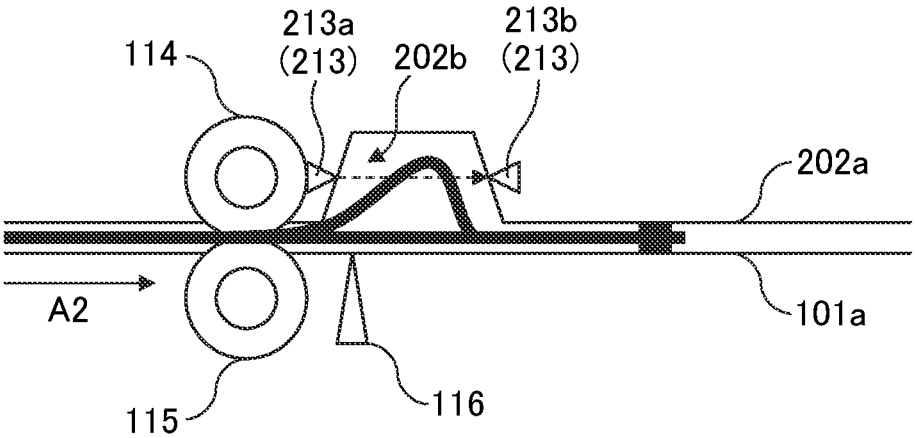
FIG. 13 is a schematic diagram illustrating a structure of a lift sensor 213.

FIG. 13 is a schematic diagram illustrating a structure of the lift sensor 213. The lift sensor 213 is located above the conveyance path of a medium and in the recessed part 202*b* formed between the separation roller 115 and the first conveyance roller 117*a*. The lift sensor 213 includes an ultrasonic transmitter 213*a* and an ultrasonic receiver 213*b*.

The ultrasonic transmitter 213*a* is located on the side of the recessed part 202*b* and outputs an ultrasonic wave along a conveying direction A2 of a medium. The ultrasonic receiver 213*b* is located in such a way as to face the ultrasonic transmitter 213*a* and receives an ultrasonic wave output by the ultrasonic transmitter 213*a*. The ultrasonic receiver 213*b* outputs a signal based on the intensity of the received ultrasonic wave as a lift signal.

When a lift of a medium does not occur, the ultrasonic receiver 213*b* directly receives an ultrasonic wave output by the ultrasonic transmitter 213*a*. When a lift of a medium occurs, the ultrasonic receiver 213*b* receives an ultrasonic wave being output by the ultrasonic transmitter 213*a* and passing through the lifting medium. Since the ultrasonic wave attenuates when passing through a medium, a lift of a medium can be detected, based on the intensity of the ultrasonic wave received by the ultrasonic receiver 213*b*.

Since the ultrasonic transmitter 213*a* and the ultrasonic receiver 213*b* do not come in contact with a lifting medium, mechanical degradation such as abrasion is not likely to occur, thereby holding down man-hours and costs of maintenance. Accordingly, by inclusion of the lift sensor 213, the medium conveying apparatus 200 enables improved maintainability.

Further, formation of the recessed part 202*b* on the second guide 202*a* avoids a lift of a medium being hindered by the second guide 202*a*. Accordingly, the medium conveying apparatus 200 enables more precise detection of a lift of a medium.

Figure 14:
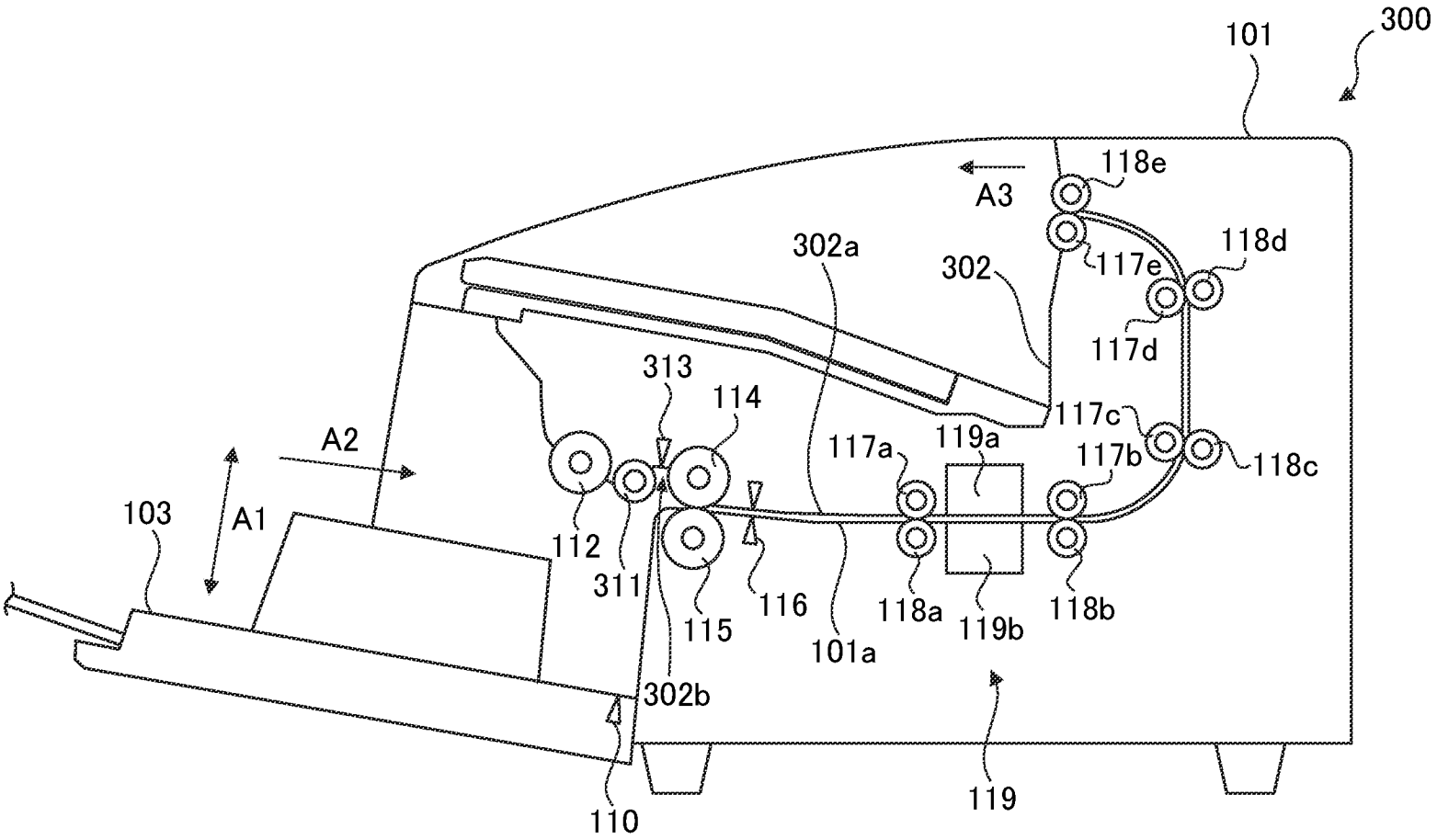
FIG. 14 is a diagram illustrating a conveyance path inside a medium conveying apparatus 300.

FIG. 14 is a diagram illustrating a conveyance path inside a medium conveying apparatus 300 according to another embodiment. The medium conveying apparatus 300 differs from the medium conveying apparatus 100 in including a second housing 302, a passing sensor 311, and a lift sensor 313 in locate of the second housing 102, the passing sensor 111, and the lift sensor 113.

The second housing 302 includes a second guide 302*a* located above a conveyance path of a medium. The second guide 302*a* is formed in such a way as to be almost parallel with a first guide 101*a*. Further, a recessed part 302*b* depressed upward is formed on the second guide 302*a* on the upstream side of a separation roller 115.

The passing sensor 311 is located on the upstream side of the separation roller 115 and on the downstream side of a pick roller 112 in such a way that the recessed part 302*b* is located between the sensor and the separation roller 115, and detects passing of a medium. A structure of the passing sensor 311 is similar to the structure of the passing sensor 111.

Figure 15:
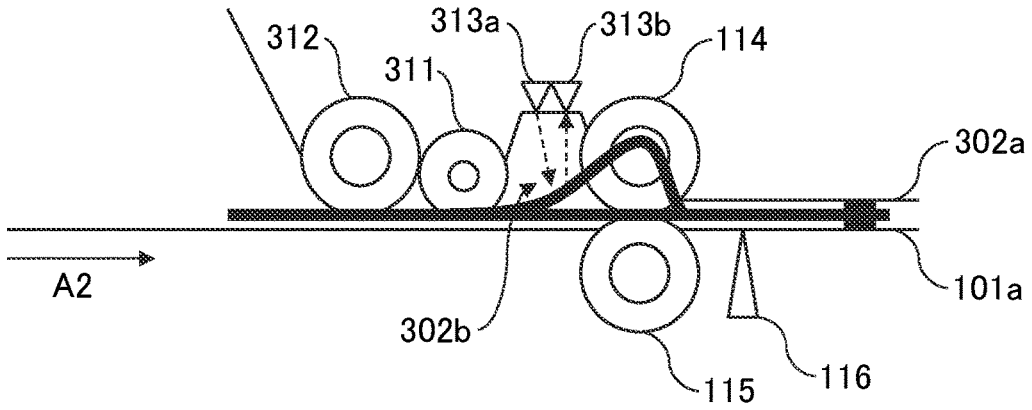
FIG. 15 is a schematic diagram illustrating a structure of a lift sensor 313.

FIG. 15 is a schematic diagram illustrating a structure of a lift sensor 313. The lift sensor 313 is located above the conveyance path of a medium and in a recessed part 302*b* formed between the passing sensor 311 and the separation roller 115. The lift sensor 313 includes a light emitter 313*a* being an LED and a light receiver 313*b* being a photodiode.

The light emitter 313*a* is located at the bottom of the recessed part 302*b* and projects light downward. The light receiver 313*b* is located at the bottom of the recessed part 302*b* and receives light being projected from the light emitter 313*a* and being reflected by a medium. The light receiver 313*b* outputs, as a lift signal, a signal indicating a value varying by the time between projection of light by the light emitter 313*a* and reception of the light by the light receiver 313*b*. For example, the lift sensor 313 detects a lift of a medium when the time between projection of light by the light emitter 313*a* and reception of the light by the light receiver 313*b*, the time being indicated by the lift signal, is less than or equal to a threshold value.

When a lift of a medium occurs, the distance between the light emitter 313*a* and the light receiver 313*b*, and the medium shortens compared with a case of a lift of the medium not occurring, and therefore the time between projection of light by the light emitter 313*a* and reception of the light by the light receiver 313*b* shortens. Accordingly, a lift of a medium can be detected, based on the time between projection of light by the light emitter 313*a* and reception of the light by the light receiver 313*b*.

Since the light emitter 313*a* and the light receiver 313*b* do not come in contact with a lifting medium, mechanical degradation such as abrasion is not likely to occur, thereby holding down man-hours and costs of maintenance. Accordingly, by inclusion of the lift sensor 313, the medium conveying apparatus 300 can enable improved maintainability.

Further, the lift sensor 313 is located on the upstream side of the separation roller 115. Consequently, the medium conveying apparatus 300 can detect a lift of a medium shortly after a bound medium arrives at the separation roller 115 and separation of the medium starts. Accordingly, the medium conveying apparatus 300 enables as much prevention of damage to a bound medium caused by an attempt to separate the medium as possible.

Various embodiments described above may be appropriately implemented in combination. For example, the lift sensor 213 may be located in the recessed part 302*b*.

Figure 16:
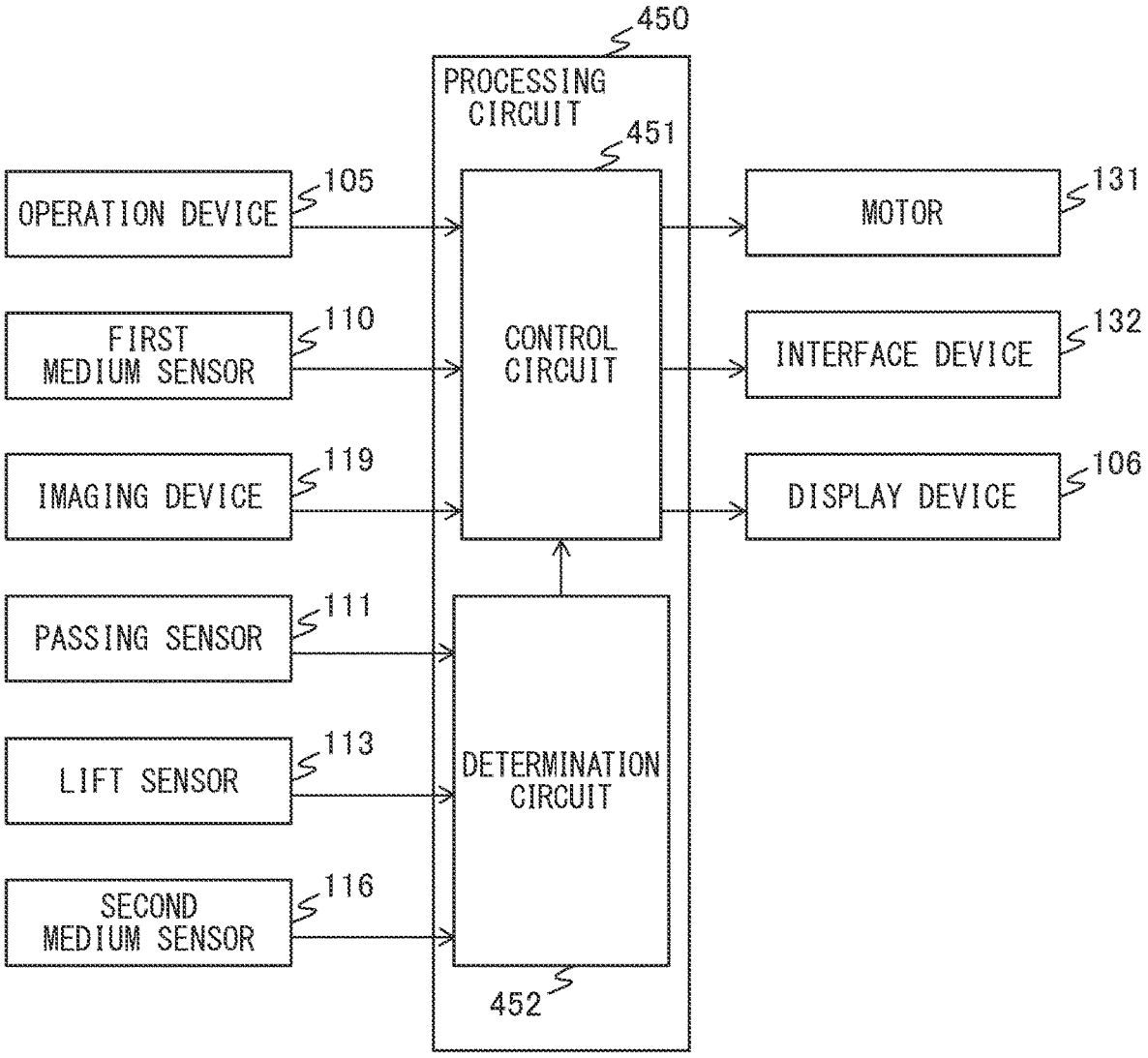
FIG. 16 is a functional block diagram of a processing circuit 450.

FIG. 16 is a diagram illustrating a schematic configuration of a processing circuit 450 in a medium conveying apparatus according to another embodiment. The processing circuit 450 is used in locate of the processing circuit 150 in the medium conveying apparatus 100 and executes the medium reading processing. The processing circuit 450 includes a control circuit 451 and a determination circuit 452. Each of the components may be independently configured with an integrated circuit, a microprocessor, firmware, or the like.

The control circuit 451 is an example of a control unit and has a function similar to that of the control unit 151. The control circuit 451 receives an operation signal from an operation device 105, a first medium signal from a first medium sensor 110, and a determination result in the determination processing from the determination circuit 452 and controls a motor 131, based on the received signals and the received determination result. Further, the control circuit 451 receives an input image from an imaging device 119 and transmits the image to an information processing device through an interface device 132.

The determination circuit 452 is an example of a determination unit and has a function similar to that of the determination unit 152. The determination circuit 452 receives a passing signal, a lift detection signal, and a second medium signal from a passing sensor 111, a lift sensor 113, and a second medium sensor 116, respectively. The determination circuit 452 determines whether a medium is a bound medium, or the like, based on the received signals and outputs the determination result to the control circuit 451.

As described above, the medium conveying apparatus enables suitable detection of a bound medium when the processing circuit 450 is used as well.

The medium conveying apparatus, medium conveying method, and computer program can precisely detect a medium on which abnormality control is to be executed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that various changes, substitutions, and alterations can be made hereto without departing from the spirit and scope of the invention.

The invention claimed is:

1. A medium conveying apparatus comprising:
a feed roller to separate and feed a medium;
a conveyance roller located on a downstream side of the feed roller in a conveying direction of the medium;
a passing sensor located on an upstream side of the feed roller in the conveying direction to detect passing of the medium;
a lift sensor to detect a lift of the medium between the passing sensor and the conveyance roller; and
a processor to
determine that the medium is a bound medium, when a lift of the medium is detected by the lift sensor and passing in the conveying direction of the medium being fed is detected by the passing sensor, and
execute abnormality control when the medium is determined to be the bound medium.

2. The medium conveying apparatus according to claim 1, wherein the processor accepts user selection of whether to continue conveyance of the medium when the medium is determined to be the bound medium.

3. The medium conveying apparatus according to claim 1, further comprising an imaging device located on a downstream side of the conveyance roller in the conveying direction, to image the medium, wherein
the processor accepts user selection of whether to continue conveyance of the medium when imaging of the medium is not started at a point in time when the medium is determined to be the bound medium, and stops conveyance of the medium when imaging of the medium has started.

4. The medium conveying apparatus according to claim 1, wherein the lift sensor includes an arm located between the passing sensor and the conveyance roller and rising according to a lift of the medium, and a detector detecting a rise of the arm.

5. The medium conveying apparatus according to claim 1, wherein the lift sensor includes a light emitter located between the passing sensor and the conveyance roller and above a conveyance path of the medium and, to project light downward and a light receiver to receive light projected by the light emitter and reflected by the medium.

6. The medium conveying apparatus according to claim 1, wherein the lift sensor includes an ultrasonic transmitter located between the passing sensor and the conveyance roller and above a conveyance path of the medium to output an ultrasonic wave along the conveying direction, and an ultrasonic receiver located to face the ultrasonic transmitter, to receive an ultrasonic wave output by the ultrasonic transmitter.

7. The medium conveying apparatus according to claim 1, further comprising a guide located above a conveyance path of the medium, wherein a recessed part depressed upward is formed on the guide between the feed roller and the conveyance roller.

8. The medium conveying apparatus according to claim 1, wherein the passing sensor detects passing of the medium when moving speed of the medium in the conveying direction is greater than or equal to a threshold value.

9. The medium conveying apparatus according to claim 8, wherein the passing sensor includes a driven roller to rotate according to movement of the medium in the conveying direction and a conversion circuit to generate voltage based on rotation speed of the driven roller.

10. The medium conveying apparatus according to claim 1, wherein
the processor
determines whether the medium is a small-sized curled medium, and
does not execute abnormality control when the medium is determined to be the small-sized curled medium.

11. A medium conveying method comprising:
separating and feeding a medium by a feed roller;
conveying the medium by a conveyance roller located on a downstream side of the feed roller in a conveying direction of the medium;
detecting passing of the medium by a passing sensor located on an upstream side of the feed roller in the conveying direction;
detecting a lift of the medium between the passing sensor and the conveyance roller by a lift sensor;
determining, by a processor, that the medium is a bound medium when a lift of the medium is detected by the lift sensor, and passing in the conveying direction of the medium being fed is detected by the passing sensor; and executing, by the processor, abnormality control when the medium is determined to be the bound medium.

12. The medium conveying method according to claim 11, further comprising accepting, by the processor, user selection of whether to continue conveyance of the medium when the medium is determined to be the bound medium.

13. The medium conveying method according to claim 11, further comprising;

imaging the medium by an imaging unit being located on a downstream side of the conveyance roller in the conveying direction and imaging the medium;

accepting user selection of whether to continue conveyance of the medium when imaging of the medium is not started at a point in time, when the medium is determined to be the bound medium; and stopping conveyance of the medium when imaging of the medium has started at the point in time when the medium is determined to be the bound medium.

14. The control method according to claim 11, wherein the lift sensor includes an arm located between the passing sensor and the conveyance roller and rising according to the lift of the medium, and a detector detecting a rise of the arm.

15. The medium conveying method according to claim 11, wherein whether the medium is a small-sized curled medium is determined, by the processor, and wherein abnormality control is not executed when the medium is determined to be the small-sized curled medium.

16. A computer-readable, non-transitory storage medium storing a computer program for a medium conveying apparatus including a feed roller separating and feeding a medium, a conveyance roller located on a downstream side of the feed roller in a conveying direction of the medium, a passing sensor being located on an upstream side of the feed roller in the conveying direction and detecting passing of the medium, and a lift sensor detecting a lift of the medium between the passing sensor and the conveyance roller, the computer program causing the medium conveying apparatus to execute a process, the process comprising:

determining that the medium is a bound medium when a lift of the medium is detected by the lift sensor, and passing in the conveying direction of the medium being fed is detected by the passing sensor; and executing abnormality control when the medium is determined to be the bound medium.

17. The storage medium according to claim 16, wherein the process further comprises accepting user selection of whether to continue conveyance of the medium when the medium is determined to be the bound medium.

18. The storage medium according to claim 16, wherein the medium conveying apparatus further includes an imaging unit being located on a downstream side of the conveyance roller in the conveying direction and imaging the medium, and the process further comprises:

accepting user selection of whether to continue conveyance of the medium when imaging of the medium is not started at a point in time, when the medium is determined to be the bound medium; and stopping conveyance of the medium when imaging of the medium has started.

19. The storage medium according to claim 16, wherein the lift sensor includes an arm being located between the passing sensor and the conveyance roller and rising according to a lift of the medium, and a detector detecting a rise of the arm.

20. The storage medium according to claim 16, wherein whether the medium is a small-sized curled medium is determined, and wherein abnormality control is not executed when the medium is determined to be the small-sized curled medium.

* * * * *